United States Patent [19]

Simmons

[11] Patent Number: 5,009,055

[45] Date of Patent: Apr. 23, 1991

[54] APPARATUS AND METHOD FOR WRAPPING BUNDLES OF NEWSPAPERS OR THE LIKE

[76] Inventor: Chris B. Simmons, 352 Meadow Rd., Kings Park, N.Y. 11754

[21] Appl. No.: 508,064

[22] Filed: Apr. 11, 1990

[51] Int. Cl.[5] ..... B65B 11/08

[52] U.S. Cl. ..... 53/397; 53/580; 53/586; 53/228; 53/466

[58] Field of Search ..... 53/397, 399, 466, 580, 53/586, 228, 230, 389

[56] References Cited

U.S. PATENT DOCUMENTS

| | | | |
|---|---|---|---|
| 2,718,738 | 9/1955 | Mast et al. . | |
| 2,860,462 | 11/1958 | Sykes | 53/580 X |
| 2,894,363 | 7/1959 | Voogo | 53/228 |
| 2,994,998 | 8/1961 | Zuercher | 53/580 |
| 3,000,151 | 9/1961 | Winkler et al. . | |
| 3,037,335 | 6/1962 | Smith | 53/228 X |
| 3,250,052 | 5/1966 | Hyer . | |
| 3,250,053 | 5/1966 | Hyer . | |
| 3,250,054 | 5/1966 | Hurlbut et al. . | |
| 3,559,367 | 2/1971 | Misik . | |
| 3,604,182 | 9/1971 | Jepsen . | |
| 3,716,960 | 2/1973 | Wright et al. . | |
| 3,892,057 | 7/1975 | Goode . | |
| 3,910,005 | 10/1975 | Thimon | 53/580 X |
| 4,080,732 | 3/1978 | Eberle | 53/228 X |
| 4,738,078 | 4/1988 | Benz et al. . | |

FOREIGN PATENT DOCUMENTS

| | | | |
|---|---|---|---|
| 2836552 | 8/1978 | Fed. Rep. of Germany . | |
| 1449696 | 7/1966 | France | 53/586 |

*Primary Examiner*—John Sipos

*Attorney, Agent, or Firm*—Dilworth & Barrese

[57] ABSTRACT

An apparatus is disclosed for wrapping a moving bundle of newspapers with a wrapping paper on three sides prior to tying the bundle with tying straps. The apparatus includes a section for stacking a bundle of newspapers and a mechanism for dispensing wrapping material at a predetermined feed rate at a location generally in the path of the bundle. Means is provided to grip the wrapping material and to guide the material upwardly so as to cause it to interfere with the path of the bundle and to cause the wrapping material to wrap itself about the bundle and to contact three adjacent surfaces of the bundle. Means is provided to cut the wrapping material when a predetermined length has been dispensed sufficient to contact and cover the three adjacent predetermined surface portions of the bundle. Appropriate pneumatic/electronic circuitry is provided to control the respective speeds and sequences such that each step of the operation is provided in timed sequence. A method of wrapping the bundle of newspaper is also disclosed. Preferably the wrapping material is kraft paper.

27 Claims, 6 Drawing Sheets

18
106
18
110
108
56
106
100
102
97
99

APPARATUS AND METHOD FOR WRAPPING BUNDLES OF NEWSPAPERS OR THE LIKE

BACKGROUND OF THE INVENTION

1. Field of the Invention

The present invention relates to an apparatus and method for wrapping bundles of newspapers or the like on three sides for protective purposes.

2. Description of the Prior Art

Bottom wrap inserting machines have been utilized in the publishing industry to insert a sheet of wrap underneath a stack of newspapers prior to tying the bundle. The wrap is generally included for protective purposes. Generally such machines dispense a sheet of durable paper underneath a moving bundle of newspapers and thereafter the bundle is tied with a suitable strapping material.

One problem common with the bottom wrap system is that during deliveries the newspapers tend to become soiled and damaged on the sides where wrap is not provided. Thus the need to provide wrap on two or more sides of the bundle has become increasingly evident and has in fact encouraged limited development in wrapping technology.

For example, machines and methods have been devised to provide wrapping of bundles of newspapers on three sides. One example of such machines is disclosed in U.S. Pat. No. 3,716,960 to Wright which relates to a method and apparatus for inserting a three-sided wrap on newspapers. The apparatus includes devices for gripping marginal portions wrap and lifting the wrap into the path of the moving bundle and thereafter releasing the margins at the precise time in the sequence. German Patent Publication No. 28 36 552 also relates to apparatus for providing three sided wrap on bundles of papers. Other patents relating to wrap inserters include U.S. Pat. Nos. 3,250,052 to Hyer, 3,250,053 to Heyer et al., 3,250,054 to Hurlbut et al., 3,604,182 to Jepsen and 3,559,367 to Misik.

While bottom wrap inserters have been successfully operative for some time, apparatus for wrapping bundles on three sides have been relatively complex. One attempt to simplify the lifting operation on the wrapping paper was to utilize a blast of air directed at the upper paper margin to force it against a cross bar so as to move with the paper. However operation of such devices were affected by extraneous air currents in the work area. Thus to date, a reliable apparatus for wrapping three sides of newspaper bundles with minimum complexity and reliably operable has yet been invented I have invented an apparatus and method for wrapping newspapers on three sides with minimum complexity and maximum efficiency while avoiding difficulties arising out of prior art machines.

SUMMARY OF THE INVENTION

An apparatus for wrapping a moving bulk article on two or more sides prior to tying the article, which comprises means to dispense the wrapping material at a predetermined feed rate at a location generally in the path of the article, means to grip an upper marginal portion of the wrapping material and to guide the material upwardly so as to cause it to interfere with the path of the article so as to cause said wrapping material to contact at least two adjacent surfaces of the article. The apparatus comprises means to cut the wrapping material when a predetermined length has been dispensed sufficient to contact and cover predetermined surface portions of the article.

A preferred embodiment of the apparatus of the invention provides for wrapping at least three adjacent surface portions of the bundle of newspaper prior to tying the bundle. The apparatus comprises means to convey the bundle in a predetermined direction toward tying means, means positioned adjacent the path of the bundle for dispensing wrapping material in a direction generally transverse to the path of the bundle, and paper guiding means to grip the upper marginal portion of said wrapping material and to guide said material upwardly into the path of the bundle as it is dispensed, so as to permit the bundle to thereby become wrapped with said material over at least two adjacent non-parallel surfaces. The speed of the wrapping material dispensing means and the conveying speed of the bundle are comparable and respectively sequenced to permit predetermined surface portions of the bundle to become wrapped with predetermined surface portions of wrapping material prior to tying the bundle.

The bundle is preferably comprised of a bundle of newspapers having a shape corresponding to the dimensions of the newspapers and the number of newspapers positioned in stacked relation. However, any stack of flat articles may be wrapped. The means positioned adjacent the path of the bundle for dispensing wrapping material in a direction generally transverse to the path of the bundle is preferably a pair of nip rolls positioned to grip the wrapping paper, to at least one of the rolls being rotatably driven. A circuit of electric valves and pneumatic cylinders are preferably provided and adapted to activate the sequence of steps to wrap the bundle.

In the preferred embodiment the newspapers are first stacked in a stacking section to form a bundle of which three sides have dimensions determined by the dimensions of the newspapers and the number of newspapers in the bundle. An electric eye is positioned to direct a beam across the path of the bundle of newspapers exiting the stacking section. The electric eye beam is arranged to activate cylinder means causing a nip roll attached thereto to grip the supply of paper within the nip of the nip roll and the continuously rotatably driven nip roll. Preferably the electric eye beam is electronically connected to activate the paper guiding means upwardly. The paper guiding means includes means to lightly grip the paper supply and move upwardly therewith to guide the paper so as to form a wall of paper which interferes with the path of the bundle. Preferably the paper guiding means is pneumatically delayed so as to coincide with the paper movement.

The apparatus further comprises cutting means to cut the paper supply in timed sequence with the position of the bundle such that the paper is cut when at least three sides of the bundle are wrapped. Conveyor means is provided for conveying the bundle of newspapers from the stacking section to the wrapping section. Means is also provided for tying the bundle of newspapers and the wrapping paper. The tying means is preferably an elongated strap positioned circumferentially about the bundle in at least one direction. However tying means may be provided on two sides of the bundle in each of at least two directions.

The electric eye is positioned at a position of interference with the beam of the eye by the bundle of newspapers substantially immediately after exiting the stacking section. Further, the wrapping section includes conveyor means at the upper surface portion and said means to grip and guide the paper is preferably a transversely extending guide bar positioned above the conveyor means of the wrapping section adjacent the exit location of the paper supply. The guide bar has attached thereto a pivotally mounted pivot arm having gripping means attached to one end thereof and positioned to engage the transverse guide bar when the paper supply is positioned therebetween. The transverse guide bar and the pivot arm are movable upwardly by pneumatic cylinder means having one end connected thereto and adapted to lift said arm at substantially the same speed as the paper rate to guide the paper into the path of the bundle. The pneumatic cylinder means is adapted by pneumatic/electric circuitry to return to the rest position substantially immediately after the bundle of newspapers is wrapped by the wrapping paper on at least three sides.

The knife means is connected to pneumatic cylinder means positioned and adapted to be activated by pressurized air supply to cause the knife means to engage and cut the paper supply when the bundle is wrapped on at least three sides by the paper. The conveyor belts are driven by a plurality of sprocket driven rolling means connected by a common chain drive, said chain drive being driven by motor driven sprocket means. Further, the bundle is conveyed through the wrapping section by at least three pairs of conveyor belts.

The tying section preferably includes a plurality of rollers rotatably mounted for permitting said bundle to be conveyed into said tying section. The transverse paper gripping arm is arranged to grip the guide bar by influence of gravity acting on the gripping bar. The transverse paper gripping bar is lifted upwardly from the paper guide bar when the guide bar and the transverse paper gripping arm are lowered to the rest position by the pneumatic cylinder means. The gripping arm is lifted upwardly from the guide bar by cam means positioned to engage the gripping arm when the gripping arm engages the camming surface during the movement to the rest position.

A method is disclosed for wrapping at least two adjacent surface portions of a bundle of papers such as newspapers or the like prior to tying the bundle, which comprises, conveying the bundle in a predetermined direction toward tying means, dispensing wrapping material in a direction generally transverse to the path of the bundle; gripping the material at an upper marginal portion and guiding the wrapping material upwardly into the path of the bundle so as to permit the bundle to thereby become wrapped with the material over at least two adjacent non-parallel surfaces; and controlling the speed of the wrapping material dispensing means and the conveying speed of the bundle so as to be comparable and respectively sequenced to permit predetermined surface portions of the bundle to become overwrapped with predetermined surface portions of overwrap material prior to tying the bundle. Preferably the material gripping step, the dispensing rate of wrapping material and the speed of the bundle are timed and sequenced to wrap the bundle on three sides.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
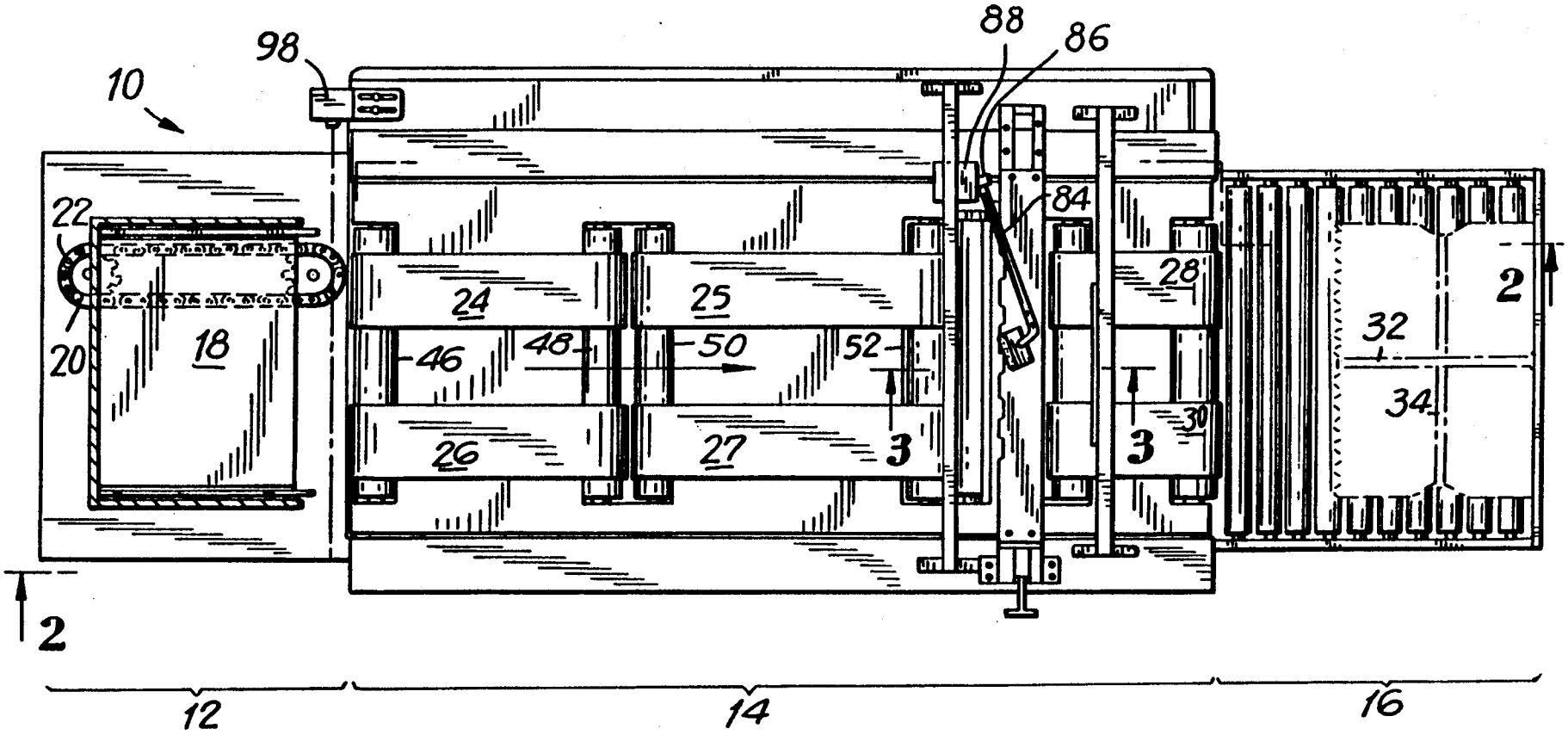
FIG. 1 is a top plan view of the apparatus constructed according to the invention.
Figure 2:
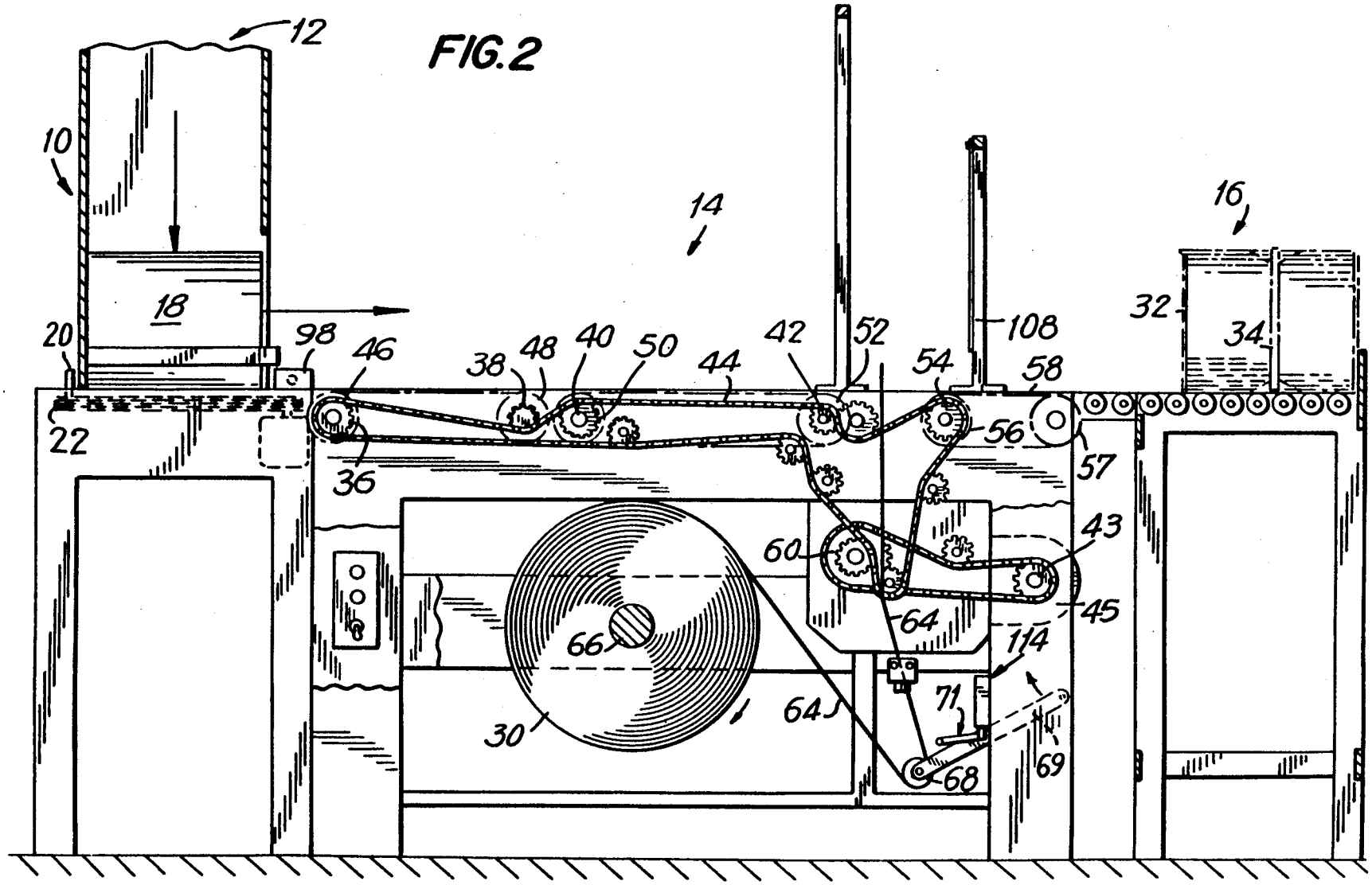
FIG. 2 is a view partially in cross-section, with parts removed, taken along lines 2—2 of FIG. 1, illustrating the power train for the apparatus of FIG. 1.

Referring initially to FIGS. 1 and 2 an apparatus 10 constructed according to the present invention is shown. The apparatus 10 includes three basic sections as shown, including a paper stacking section 12, wrapping section 14 and tying section 16. The paper stacking section receives newspapers and facilitates stacking them into bundles as shown at 18 in FIG. 2. Thereafter, the bundle is engaged by vertically extending pin 20 attached to rotating sprocket 22 shown in FIG. 1, causing the bundle to advance sufficient to move onto moving conveyor belts 24, 25, 26 and 27 of wrapping section 14. The rotation of the sprocket 22 is timed in sequence with bundle formation. While in wrapping section 14 the bundle is wrapped on the leading and top and bottom sides. After the wrapping procedure, the bundle is conveyed by continuously moving conveyor belts 28 and 30 to tying section 16 where it is tied by a suitable strap or straps 32 and 34 which extend circumferentially therearound to secure the newspapers together. Straps 32 and 34 are shown in FIG. 1 and may be in the form of a suitable plastic strap which is secured by heat sealing both ends together. Alternatively, one such heat sealed strap may be utilized or other tying means such as wire may be used. After the strapping operation of tying section 16, the bundle is conveyed to other areas for processing and delivery to distributors or end users.

Figure 3:
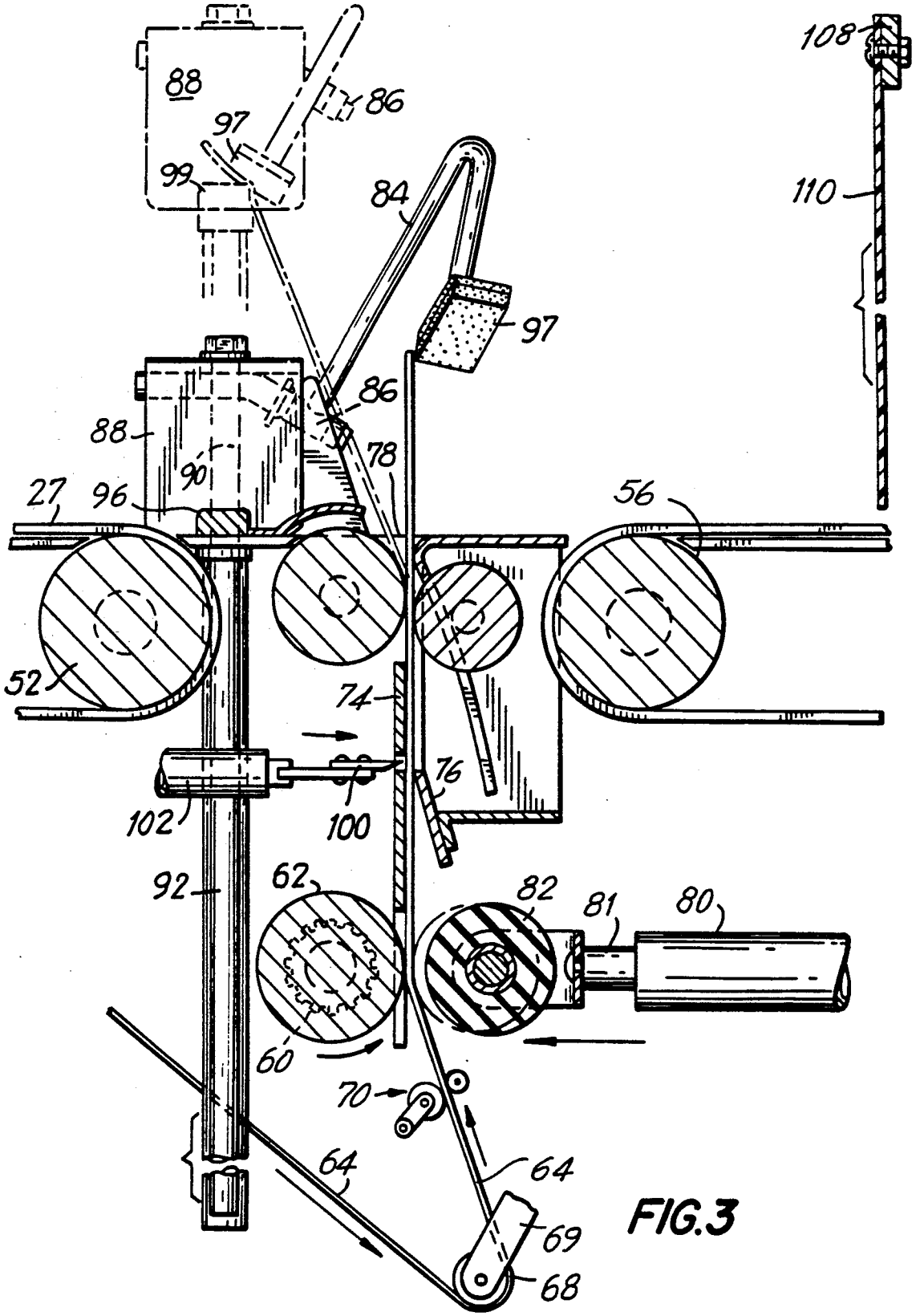
FIG. 3 is a view partially in cross-section, taken along lines 3—3 of FIG. 1 and illustrating the paper guiding feature of the apparatus of FIG. 1.

Referring now to FIG. 2, the drive train and basic structural arrangement of the overwrapping section 14 of the apparatus is illustrated. The wrapping section 14 includes a plurality of sprockets 36, 38, 40 and 42 which are continuously driven by chain 44 through drive sprocket 43 driven by motor 45 via drive chain 45 and double sprocket 60 to continuously rotatably drive respective rollers 46, 48, 50 and 52. These rollers drive conveyor belts 24 and 26 as shown in FIG. 1 to convey the bundle through the overwrapping section 14. Sprocket 54 drives roller 56 to drive conveyor belts 28 and 30 about idler roller 57, and double sprocket 60 drives roller 62, shown in FIG. 3, to engage and move paper supply 64 upwardly into the path of the bundle of newspapers 18 as will be described hereinbelow. Only the inner portion of sprocket 60 is shown in FIG. 3. There are two continuous and endless drive chains 44 and 45 which drive and connect the sprockets as shown in FIG. 2. These sprockets and drive chains are continuously operative as shown to maintain the process of conveying, wrapping, and tying bundles of newspapers.

Figures 5, 6:
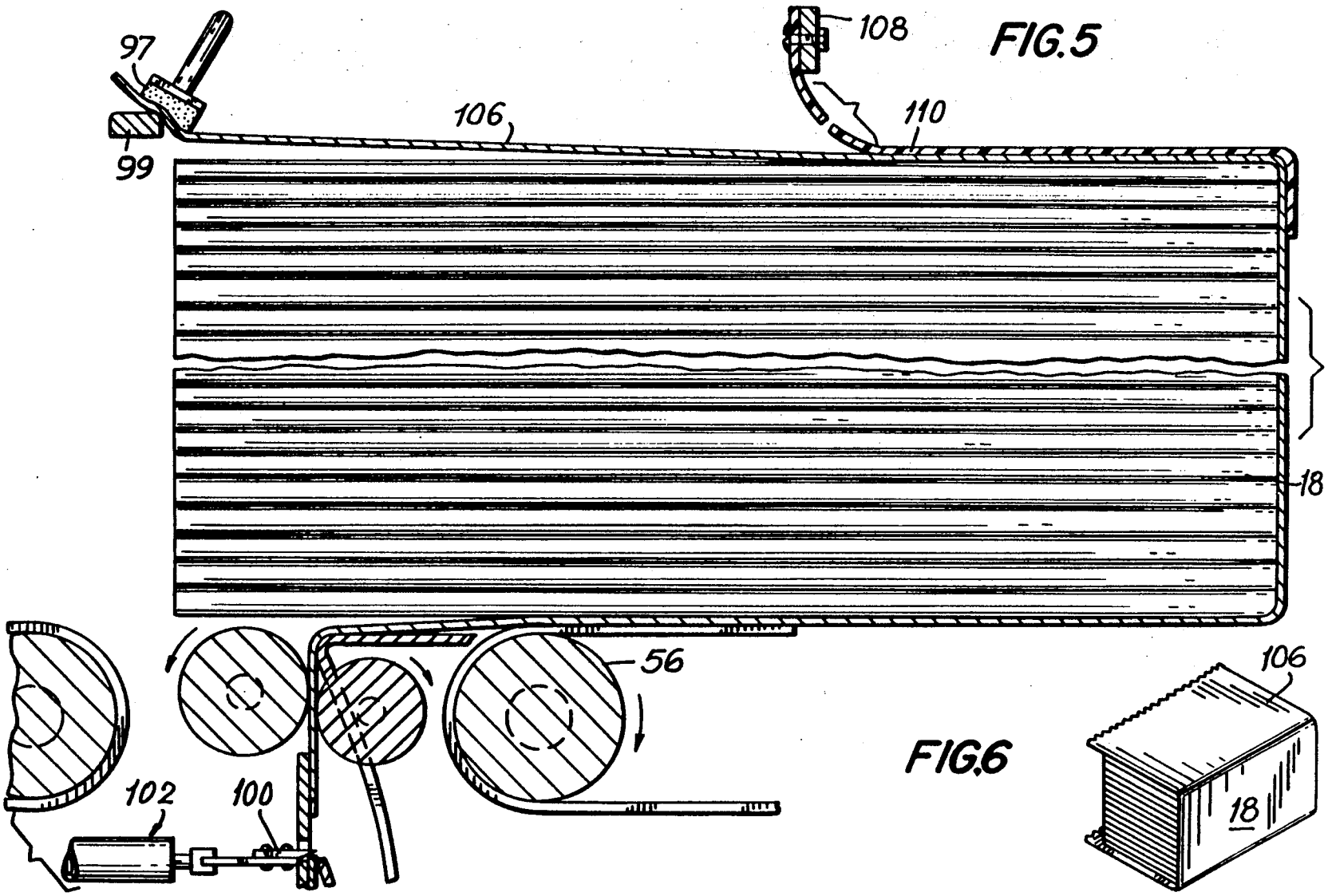
FIG. 5 is a view partially in cross-section, of a bundle of newspapers travelling through a wall of overwrap kraft paper on the apparatus of FIG. 1 so as to be wrapped by the paper.
FIG. 6 is a perspective view of a bundle of newspapers after being, wrapped on three sides on the apparatus of FIG. 1.

The overwrapping section and operation thereof will now be described. The use of the term "wrapping" or "overwrapping" herein refers to wrapping the bundle of newspapers on three sides, i.e. the leading, top and bottom sides as shown in FIG. 6 with a suitable wrapping paper. A typical example of such paper which is commonly used is referred to as "kraft paper", which is a sturdy and durable paper commonly used for wrapping bundles of newspapers, generally on one side. Other types of paper are contemplated. In addition, all types of papers other than newspapers, are also contemplated wherever the papers are stacked for shipment, i.e. magazines, circulars, etc.

Referring to FIG. 2, roll 30 of kraft paper supply 64 is rotatably mounted on rotatable spindle bar 66. The paper supply 64 extends tangentially to roll 30 as shown and around adjustable dancer roll 68 and associated nip guide roll 70 and extends upwardly past rotatably driven roll 62 shown in FIG. 3, which is driven by sprocket 60 in the direction of the arrow as shown. Thereafter, the paper supply 64 extends upwardly past slotted guide plates 74 and 76 to exit out of opening 78 at the upper surface of section 14 as shown. The driving medium for the paper is provided when piston rod 81 of cylinder 80 shown in FIG. 3, extends forwardly to engage the paper supply causing rubber roll 82 to engage the paper thereby providing a nip between roll 82 and continuously driven roll 62 causing driven roll 62 to drive the paper upwardly toward the exit opening 78 and in the path of the bundle of newspapers as will be described in further detail. The initial paper drive is provided when dancer roll bar 69 rotates upwardly to contact switch 71 which directs arm to a roll drive cylinder. This occurs prior to the start of rotation of paper roll 30.

Turning now to FIGS. 1-3, the kraft paper guide feature will be described. Guide bar 84 is mounted for pivotal movement about pin 86 attached to angle frame section 88. Angle section 88 is in turn attached to piston rod 90 of pneumatic cylinder 92 while stabilizing bar 94 is slidably positioned within circular bearing 96 to stabilize the upward and downward movement of the guiding apparatus. At an appropriate time within the sequence—i.e., when the bundle of newspapers exits the stacking section 12, the beam of electric eye 98 is broken by the bundle 18 and an appropriate electric circuit activates an electrically driven pneumatic valve which causes piston rod 90 of pneumatic cylinder 92 to extend upwardly and cause arm 84 to pivot downwardly under the force of gravity causing friction pad 97 to engage paper supply 64, lightly forcing it against the cross-bar 98 and stabilizing the paper while gripping and guiding it gently upward as the bundle 14 of newspapers moves forward. Just prior thereto the paper feed started feeding paper upwardly in timed sequence. It is important that the rate of upward movement of the guiding apparatus is the same as the paper feed rate.

This movement of paper presents a "wall" of kraft paper in the path of the bundle 18 such that as the bundle s is conveyed through the wall the paper becomes physically wrapped around three sides as shown in FIG. 5, i.e. the leading, top and bottom sides. At an appropriate time in the sequence the circuitry is activated to direct pressurized air to a pneumatic cylinder (not shown) causing piston rod 102 of that cylinder and attached knife 100 (shown in FIG. 3) to be moved in the direction of the arrow, causing knife 100 to enter slot 104 thereby cutting the paper along a line immediately above guide plates 74 and 76. At this time, the bundle is overwrapped on three sides and it proceeds to the tying section 16 where it is tied by one or two straps as shown in FIG. 1. Thereafter the bundle is conveyed further for distribution.

Figure 4:
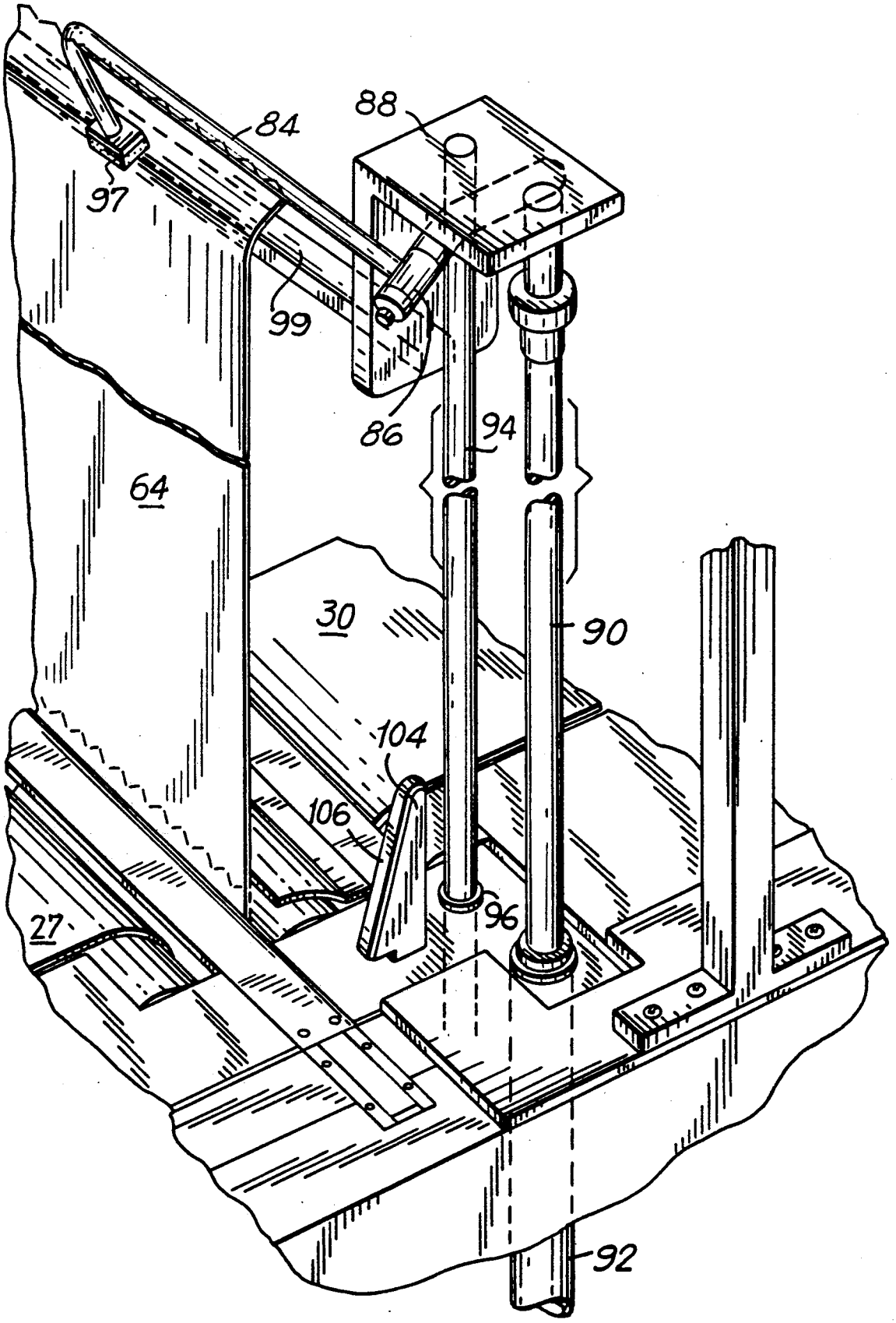
FIG. 4 is a perspective view of the paper guiding mechanism of the apparatus of FIG. 1.

Turning once again to FIGS. 1, 3 and 4, once the paper has been cut, the circuitry causes withdrawal of rod 90 of cylinder 92, permitting downward movement of angle bracket 88 and transverse arm 84 toward the horizontal conveyor surface. Upon return of the paper pinch and guide apparatus to the conveyor, the transverse arm 84 engages cam member 104 having a generally triangular configuration as shown in FIG. 4. The engagement of transverse arm 84 with the longer side 106 of cam member 104 actually causes arm 84 to lift upwardly and pivot upwardly causing movement of friction pad 97 upwardly away from movable cross bar 99 in preparation for the next wrapping operation.

Referring now to FIG. 5, the actual overwrapping operation or bundle 14 is illustrated in elevational view. The cutting action of knife 100 takes place in timed sequence through piston 102, with the length of wrap around bundle 14. At this time, the bundle proceeds on the conveyor belts 28 and 30 shown in FIG. 1 and wrap section 106 is removed from the grip between pad 97 and cross bar 99. Since the grip therebetween is a relatively light friction guide grip, the force provided by the movement of the bundle of newspaper is sufficient to slidably remove the paper from the grip of pad 97 and cross bar 99.

Referring once again to FIGS. 2 and 5 there is shown a cross bar 108 which has suspended a downwardly extending flexible curtain 110 which wipes the upper surface of the kraft wrap 106 as it is becoming wrapped around the bundle. This curtain is preferably a flexible, thick material which will actually stabilize the kraft paper wrap on top of the bundle by providing uniform downward pressure to temporarily secure it against the bundle as it moves from the wrapping to the tying section. A curtain of rubber or plastic about 1/4 inch thick has been found to be suitable. The pre-tied overwrapped bundle is shown in FIG. 6 in the form of a bundle of newspapers wrapped by kraft paper 106 about three sides. The dimensions of the bundle are determined by the lengthwise and widthwise dimensions of the newspapers and the number of newspapers in the bundle. Thus the timing sequences in the system can be appropriately adjusted.

Figure 7:
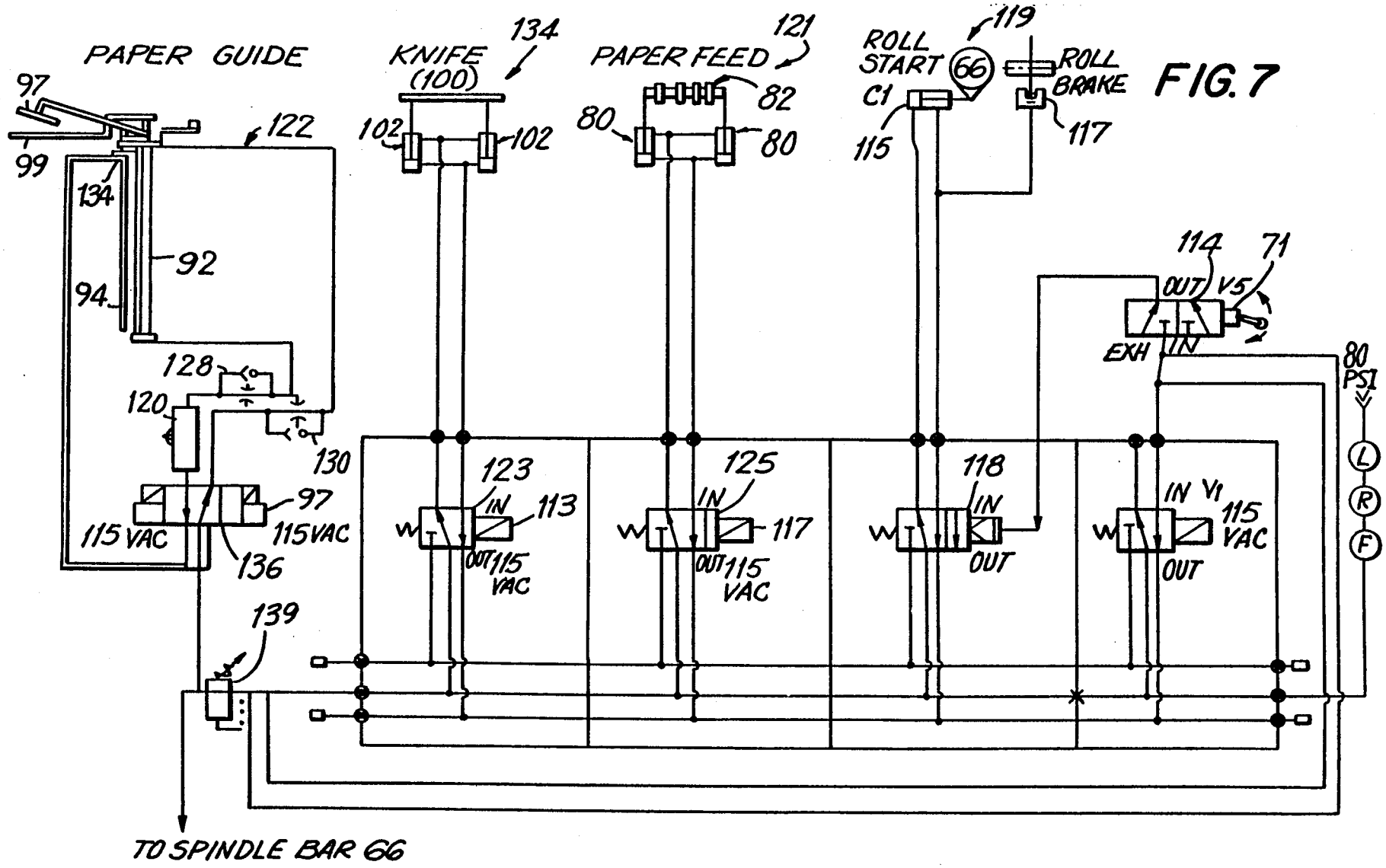
FIG. 7 is a schematic flow chart illustrating diagrammatically, the pneumatic and electronic features of the present invention.

In FIG. 7 ⊗ means a side-port connection, X means a port plug, and ⊗ means a side-port plug.

An electric pneumatic flow chart is shown in FIG. 7 and is of a type which generally provides the following sequence:

1. Bundle 18 of newspapers accumulates in stacking section 12.

2. Bundle 18 exits stacking section 12 and breaks beam of electric eye 98.

3. Broken beam of electric eye—with appropriate circuitry—causes paper engaging roll 82 to engage kraft paper 64 and provide nip with continuously rotating paper drive roll 62; simultaneously, cylinder 92 activates piston rod 90 and guide arm 84 upwardly, gripping paper between pad 97 and cross bar 99 and guiding it upwardly.

4. Paper bundle 18 continues through wall of kraft paper until three sides are covered; appropriate circuitry accurately monitors with, time delays, to coincide with speed of paper to activate piston rod 102 of air cylinder (not shown) to activate knife 100, cutting paper, permitting overwrapped bundle to proceed forwardly; grip between pad 96, paper 64 and cross bar 99 is released when paper slips through by the force of the bundle 18 moving forward;

5. Timed sequence causes reversal of direction of air to pistons 80 and 92, causing withdrawal of roller 82 away from paper supply 64 and withdrawal of piston rod 90 into cylinder 92 until guide arm 84 falls to top surface of section 14 and engages cam 104, causing guide arm to be lifted away from cross bar 99 by pivotal movement of the inner end about pin 86 in preparation for repeat of sequence.

Such systems use well known electronic/pneumatic solenoids as shown in FIG. 7, which are electrically driven to permit the air supply to enter the appropriate section of the appropriate pneumatic cylinder in predetermined timed sequence.

It is of particular interest to note that the actual electric and pneumatic circuitry utilizes timed sequential operations which are significant in the overwrapping operation. For example, as the bundle exits the stacking section 12, the electric eye and the appropriate circuitry causes immediate responses in directing cylinder 80 to cause elastomer roll 82 to nip paper supply 64 with rotating roll 62 to move paper supply 64 upwardly by action of rotating driven roll 62. Thus the time delay is critical to permit a sufficient length of paper to extend upwardly. Also simultaneously, the upward movement of piston rod 90 of cylinder 92 begins, permitting sufficient time lapse, to lift sufficient amount of paper to form the requisite wall of paper. This is followed by actuation of cylinder 102 and cutting knife 100 to cut paper supply 64 in precise timed sequence with the positioning of the paper around three sides of the bundle. Thereafter the electric and pneumatic circuitry causes the return of the components, including the withdrawal of piston rod 81 of cylinder 80 and return of piston rod 90 of cylinder 92 in preparation for the next wrapping operation sequence.

Referring now once again to FIG. 7, there is shown a diagrammatic flow chart illustrating the electronic/pneumatic operative features of the present invention. Pneumatic pressure source of approximately 80 psi activates the system which includes (1) Roll start system 119, with brake 117
(2) Paper feed system 121
(3) Knife system 134
(4) Paper guide system 122

Referring to FIG. 7 when bundle 18 exits the stacker section 12 the electrical system is activated by electric eye 98, thus electrically activating valve 123 causing movement of piston 81 of paper feed cylinder 80 to cause the paper feed rolls 62 and 82 to feed paper 64 upwardly. Valve 114 is activated by motion switch 71 which is tipped by movement of dancer arm 69 and engaged by dancer roll 68 due to the upward movement of the paper 64 prior to activation of roll start system 119. Dancer arm 69 is present to maintain a predetermined paper tension during the operation. When switch 71 is activated, valve 114 directs pneumatic pressure to valve 118 which in turn activates the roll start cylinder system 115. This provides an initial drive to begin rotation of large paper roll 30. Roll brake 117 is also provided to brake paper roll 30 thereby overcoming the natural inertia of the roll. Other similar electrically operated pneumatic valves are provided for the remaining circuits.

Next, pneumatic delay valve 120 in the pa guide circuit 122 is activated causing the paper guide 97/99 to grip the paper 64 and to rise at the same speed as the paper feed after an appropriate delay which permits the paper guide to "catch up" with the paper movement. Return speed of paper guide cylinder 92 is governed by flow control valve 128 in the return portion of paper guide circuit 122 and by flow control valve 130 in the up direction. Further, since the air exhausted from paper guide cylinder 92 is laden with pneumatic oil, it is directed at 134 onto guide shaft 94 to clean and lubricate the guide shaft. The significance of pneumatic delay valve 120 will be appreciated by the necessity to delay the lifting of the paper guide system until paper is actually fed out of exit opening 78. Thus such delay of the paper guide system will cause the guide system to grip the paper at the precise instant required. At this time, since the speed rate of the paper is matched to the speed of the paper guide system the paper will be maintained in a steady position while rising, unaffected by outside influences such as air currents or the like.

Before the paper guide system rises to its highest position, paper feed system 121 will be deactivated and knife system 134 will be activated to cause knife 100 to cut paper 64. At this instant the same signal causes activation of valve 136 to reverse the direction of paper guide cylinder 92 causing the paper guide bar 99 and gripper 96 to return to the start position at a rate predetermined by flow control valve 130. At the same time cylinder 102 which controls knife 100 is caused to return to its initial "ready" position in preparation for the next cycle. Low pressure regulator 139 is provided in the pneumatic system to supply spindle bar 66 and paper guide cylinder 92 with low pressure not above 40 psi.

The timing of electrical activated valves 125 for the paper feed 121 and 123 for the knife 100 and 136 for paper guide 122 are electrically timed to be activated by electrical circuits 113, 117 and 97 respectively, as shown. At all times 80 p.s.i. air pressure is made available as shown.

What is claimed is:

1. An apparatus for wrapping a bulk article moving along a conveyor path on two or more sides prior to tying the article, which comprises:

(a) means to dispense the wrapping material from a location below the path of the article and at a predetermined feed rate to a location generally in the path of the article;
(b) means to grip an upper marginal portion of the wrapping material;
(c) means for moving said gripping means upwardly at substantially the same rate as said predetermined dispensing feed rate to guide said material upwardly to cause said material to interfere with the path of the article and contact at least two adjacent surfaces of the article; and
(d) means to cut said wrapping material when a predetermined length has been dispensed sufficient to contact and cover predetermined surface portions of the article.

2. An apparatus for wrapping at least two adjacent surface portions of a bundle of papers such as newspapers or the like prior to tying the bundle, which comprises:

(a) means to substantially horizontally convey the bundle in a predetermined direction toward tying means;

(b) means positioned below the path of the bundle for dispensing wrapping material at a dispensing feed rate and in a direction generally transverse to the path of the bundle; and (c) paper guiding means to grip the upper marginal portion of said wrapping material;

(d) means for moving said gripping means upwardly at a rate substantially equal to said dispensing rate of said wrapping material so as to guide said material upwardly into the path of the bundle to permit the bundle to thereby become wrapped with said material over at least two adjacent surfaces;

the speed of said wrapping material dispensing means and the conveying speed of the bundle being comparable and respectively sequenced to permit predetermined surface portions of the bundle to become wrapped with predetermined surface portions of wrapping material prior to tying the bundle.

3. The apparatus according to claim 2 wherein the bundle is comprised of a bundle of newspapers having a shape corresponding to the dimensions of the newspapers and the number of newspapers positioned in stacked relation

4. The apparatus according to claim 3 wherein said means positioned adjacent the path of the bundle for dispensing wrapping material in a direction generally transverse to the path of the bundle is a pair of nip rolls positioned to grip the wrapping paper, at least one of said rolls being rotatably driven.

5. The apparatus according to claim 4 further comprising a circuit of electric valves and pneumatic cylinders adapted to activate the sequence of steps to wrap the bundle.

6. The apparatus according to claim 5 wherein said newspapers are first stacked in a stacking section to form a bundle of three sides having dimensions determined by the dimensions of the newspapers and the number of newspapers in the bundle.

7. The apparatus according to claim 6 wherein an electric eye is positioned to direct a beam across the path of said bundle of newspapers exiting sad stacking section, said electric eye beam being arranged to activate cylinder means causing a nip roll attached thereto to grip the supply of paper within the nip of said nip roll and said continuously rotatably driven nip roll.

8. The apparatus according to claim 7 wherein said electric eye beam is electronically connected to activate said paper guiding means upwardly, said paper guiding means including means to lightly grip the paper supply and move upwardly therewith to guide the paper so as to form a wall of paper which interferes with the path of the bundle.

9. The apparatus according to claim 8 wherein said paper guiding means is pneumatically delayed so as to coincide with the paper movement.

10. The apparatus according to claim 9 further comprising cutting means to cut the paper supply in timed sequence with the position of the bundle such that the paper is cut when at least three sides of the bundle are wrapped.

11. The apparatus according to claim 10 further comprising conveyor means for conveying the bundle of newspapers from the stacking section to the wrapping section.

12. The apparatus according to claim 11 further comprising means for tying the bundle of newspapers and said wrapping paper.

13. The apparatus according to claim 10 wherein said tying means is an elongated strap positioned circumferentially about the bundle in at least one direction.

14. The apparatus according to claim 10 wherein said tying means is at least one strap positioned circumferentially about the bundle in each of at least two directions.

15. The apparatus according to claim 13 wherein said electric eye is positioned at a position of interference with the beam of said eye by the bundle of newspapers substantially immediately after exiting said stacking section.

16. The apparatus according to claim 13 wherein said wrapping section includes conveyor means at the upper surface portion and said means to grip and guide the paper is a transversely extending guide bar positioned above said conveyor means of said wrapping section adjacent the exit location of the paper supply, said guide bar having attached thereto a pivotally mounted pivot arm having gripping means attached to one end thereof and positioned to engage said transverse guide bar when the paper supply is positioned therebetween, said transverse guide bar and said pivot arm being movable upwardly by pneumatic cylinder means having one end connected thereto and adapted to lift same at substantially the same speed as the paper rate to guide the paper into the path of the bundle.

17. The apparatus according to claim 16 wherein said pneumatic cylinder means is adapted by pneumatic/electric circuitry to return to the rest position substantially immediately after the bundle of newspapers is wrapped by the wrapping paper on at least three sides.

18. The apparatus according to claim 17 wherein said knife means is connected to pneumatic cylinder means positioned and adapted to be activated by pressurized air supply to cause said knife means to engage and cut the paper supply when the bundle is wrapped on at least three sides by the paper.

19. The apparatus according to claim 16 wherein said conveyor means comprise conveyor belts driven by a plurality of sprocket driven rolling means connected by a common chain drive, said chain drive being driven by motor driven sprocket means.

20. The apparatus according to claim 19 wherein said bundle is conveyed through said wrapping section by at least three pairs of conveyor belts.

21. The apparatus according to claim 20 wherein said tying section includes a plurality of rollers rotatably mounted for permitting said bundle to be conveyed into said tying section.

22. The apparatus according to claim 21 wherein said pivot arm is a paper gripping arm arranged to grip said guide bar by influence of gravity acting on said gripping arm.

23. The apparatus according to claim 21 wherein said transverse paper gripping bar is lifted upwardly from said paper guide bar when said guide bar and said transverse paper gripping arm are lowered to the rest position by said pneumatic cylinder means, said gripping arm being lifted upwardly from said guide bar by cam means positioned to engage said gripping arm when said gripping arm engages the camming surface during the movement to the rest position.

24. A method for wrapping at least three adjacent surface portions of a bundle of papers such as newspapers or the like prior to tying the bundle, which comprises:

(a) conveying the bundle in a predetermined direction toward tying means;

(b) dispensing wrapping material from a location below and in a direction generally transverse to the path of the bundle at a predetermined dispensing rate;

(c) gripping said material at an upper marginal position and guiding said wrapping material upwardly int to path of the bundle at substantially the same rate as said predetermined dispensing rate so as to permit the bundle to thereby become wrapped with said material over at least two adjacent surfaces; and (d) controlling the speed of said wrapping material dispensing means and the conveying speed of the bundle so as to be comparable and respectively sequenced to permit predetermined surface portions of the bundle to become overwrapped with predetermined surface portions of overwrap material prior to tying the bundle.

25. The method according to claim 24, wherein said material gripping and guiding step, the dispensing rate of said wrapping method and the speed of the bundle are timed and sequenced to wrap the bundle of paper on three sides.

26. The method according to claim 25 wherein said guiding step avoids any substantially upward pulling on the upper marginal portion of said wrapping material.

27. An apparatus for wrapping at least three surface portions of a bundle of papers such as newspapers or the like moving along a substantially horizontal conveyor path prior to tying the bundle, which comprises:

(a) means to convey the bundle in a predetermined direction toward tying means;

(b) means positioned below the path of the bundle for dispensing wrapping material from below at a dispensing feed rate and in a direction generally transverse to the path of the bundle;

(c) paper guiding means to grip the upper marginal portion of said wrapping material;

(d) means for moving said gripping means upwardly at a rate substantially equal to said dispensing rate of said wrapping material so as to avoid any substantial upward pulling on the upper marginal portion of said wrapping material to guide said material upwardly into the path of the bundle to permit the bundle to thereby become wrapped with said material over at least three surfaces;

the dispensing feed rate of said wrapping material and the conveying speed of the bundle being comparable and respectively sequenced to permit predetermined surface portions of the bundle to become wrapped with predetermined surface portions of wrapping material prior to tying the bundle.

* * * * *